United States Patent [19]

Morley et al.

[11] Patent Number: 4,616,474

[45] Date of Patent: Oct. 14, 1986

[54] MOBILE FILM WRAPPING APPARATUS

[75] Inventors: Edmond Morley, Chester; Neil DiLorenzo, Campbell Hall; James Karras, Kerhonkson, all of N.Y.

[73] Assignee: Wrap & Roll, Inc., Fort Lee, N.J.

[21] Appl. No.: 727,374

[22] Filed: Apr. 25, 1985

[51] Int. Cl.[4] ..... B65B 13/10

[52] U.S. Cl. ..... 53/556; 53/588; 219/469

[58] Field of Search ..... 53/441, 556, 588, 210; 264/DIG. 73; 425/143; 219/469, 470, 471, 202

[56] References Cited

U.S. PATENT DOCUMENTS

| | | | |
|---|---|---|---|
| 2,547,835 | 4/1951 | Pfeiffer | 53/441 |
| 2,597,041 | 5/1952 | Stokes | 53/556 |
| 2,701,765 | 2/1955 | Codichini | 219/470 |
| 2,834,860 | 5/1958 | Gaiborne | 219/469 |
| 3,239,652 | 3/1966 | Price | 219/469 |
| 3,619,539 | 11/1971 | Taylor | 219/469 |
| 3,796,785 | 3/1974 | Rest | 264/DIG. 73 |
| 4,051,643 | 10/1977 | Saito | 53/30 |
| 4,067,174 | 1/1978 | Goldstein | 53/556 |
| 4,095,395 | 6/1978 | Goldstein | 53/210 |
| 4,465,450 | 8/1984 | Dermansky | 425/143 |

FOREIGN PATENT DOCUMENTS

| | | | |
|---|---|---|---|
| 427654 | 7/1967 | Switzerland | 219/469 |
| 1487512 | 10/1977 | United Kingdom | 53/210 |
| 2124176 | 2/1984 | United Kingdom | 53/556 |

OTHER PUBLICATIONS

Material Handling Engineering, Jan. 1983, pp. 70–72, PS&D Brochure.

"Heated Roller Modification Cuts Stretch Wrap Costs", *Package Engineering*, Nov. 1982.

*Primary Examiner*—John Sipos

*Attorney, Agent, or Firm*—Heslin & Rothenberg

[57] ABSTRACT

Mobile film wrapping apparatus for unitizing a load is attached to a self propelled vehicle and powered by the vehicle's D.C. power supply. The film wrapping apparatus includes a supporting structure for holding a supply roll of film in a generally vertical orientation. The speed at which the film is dispensed from the supply roll is controlled by an electrically powered adjustable tension brake. The film is wound around a self contained heated roller which facilitates prestretching of the film prior to wrapping. The heated roller contains a supply of heating fluid, a D.C. heating element, a thermostatic switch and an auxiliary rapid heat-up A.C. heating element. Power is provided to the heated roller via a slip ring assembly.

4 Claims, 6 Drawing Figures

MOBILE FILM WRAPPING APPARATUS

BACKGROUND OF THE INVENTION

1. Technical Field

This invention relates to apparatus for unitizing goods by wrapping stretch film around the goods and more particularly to a mobile film wrapper.

2. Background Information

Today it is a common practice to prepare bulk goods for transport by wrapping them with stretch film. This unitizing process is generally implemented with large stationary film wrapping equipment set up at a fixed location. The load, i.e. goods to be wrapped, must be transported to said location and then passed through, or under, or rotated within, the stationary film wrapping apparatus.

Such stationary film wrappers have reached a high level of sophistication, generally provide excellent results, and accordingly have been widely employed. However, in certain applications, this fixed equipment exhibits significant limitations. The stationary film wrappers generally require auxillary conveyers, turntables or other material handling equipment for moving the load during the wrapping process. Further the stationary film wrappers are generally large and bulky limiting the locations at which they can be erected. They tend to be complex pieces of equipment, making their initial acquisition costs high and the risk of equipment failure and the cost of maintenance and repair not inconsequential. Further, since all goods must be transported to the wrapping station, a bottleneck can develop resulting in long lines and associated lost time and tied-up transport vehicles.

Many of the stationary film wrapping structures employ a pre-stretch device to stretch film as it is being applied to the load. Some employ a heated roller for this purpose, along with a separate fluid tank, pump, hoses and other hydraulic equipment.

Portable stretch film wrappers have previously been developed. Those known to applicants are either hand held, mounted on operator manuevered psuch carts, or robotically controlled. These are cold wrap devices and can be awkward and laborious to use, slow in operation, and wasteful of film.

A need thus exists for film wrapping apparatus which overcomes the shortcomings of both existing stationary and portable film wrappers.

SUMMARY OF THE INVENTION

The present invention satisfies this need by providing a mobile self contained film wrapper which travels to a load, rapidly encircles the load with heat stretched film dispensed under controller tension and then moves on to another load. The film wrapper of the present invention can be readily attached to any self propelled vehicle affording it great mobility and versatility. The relative simplicity of its design permits easy construction and operation, and reduced acquisition and maintenance costs. Waiting lines associated with stationary wrappers are avoided while productivity is enhanced, relative to prior portable cold wrap devices, due to the present invention's greater mobility and use of heat activated prestretched film. The latter also results in a saving of film since fewer wraps of the prestretched film are needed to unitize a load.

The improved film wrapper of the present invention includes supply roll holding means, film dispensing speed control means, and rotatable heated roller means mounted on a common compact support structure for attachment to a self-propelled vehicle. The film wrapper is powered by the same D.C. source that drives the self-propelled vehicle and is virtually fully self contained. The heated roller means is specially designed to contain the heating fluid, an immersed D.C. heating element, a supplementary rapid heat-up A.C. heating element, and a thermostatic switch. A slip ring assembly is advantageously employed to provide electrical power to the heating elements and thermostatic switch. A control panel includes switches for activating the various elements of the film wrapper and indicator lights for displaying their status. Together these elements provide the numerous advantages described herein.

Accordingly, a primary object of this invention is to provide a mobile, cost and time effective, film wrapping apparatus which avoids the bottlenecks associated with fixed wrappers and affords enhanced productivity relative to existing portable devices.

Another object is to provide such mobile film wrapping apparatus which is self contained, power driven, readily constructed, and straightforward and safe to operate.

A further object is to provide such film wrapping apparatus which is highly versatile, compact, sturdy, and economical to manufacture and operate.

Yet another object is to provide a mobile film wrapper which enjoys many of the advantages of stationary film wrapping equipment without the limitations attendant to such equipment.

A still further object is to provide a film wrapper which expedites the unitizing process, conserves film and is affordable.

These and other objects, features and advantages will be more readily understood from the subsequent detailed description of the invention read in conjunction with the accompanying drawings in which:

DETAILED DESCRIPTION

Figure 1:
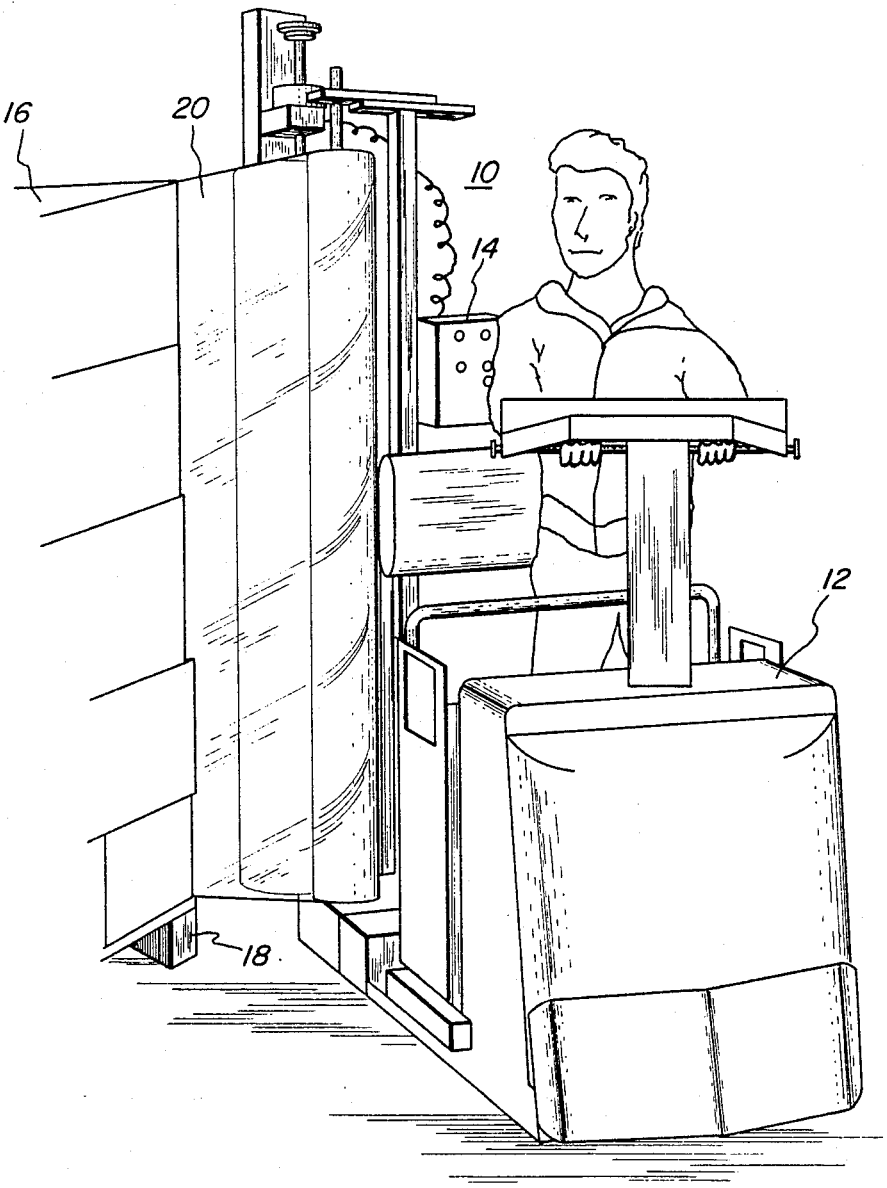
FIG. 1 is a perspective view of the mobile film wrapper of the present invention in use.

FIG. 1 illustrates a preferred form of the mobile film wrapping apparatus of the present invention in use. The film wrapping apparatus, generally denoted by reference character 10, is attached to the rear of a self propelled vehicle 12. Vehicle 12 may be a tow tractor, tug, forklift or similar power driven vehicle commonly employed at warehouse operations and similar facilities. Such vehicles are typically battery powered and highly maneuverable and versatile. The film wrapping apparatus 10 may be either permanently or removably secured to vehicle 12 using an available hitch mechanism or other securing means.

A control panel 14 for the film wrapping apparatus is mounted either on apparatus 10 or vehicle 12 in a position in which it is readily accessible to the vehicle operator. The function of control panel 14 will be described hereinafter with respect to FIG. 5.

As shown in FIG. 1, bulk goods 16 on the pallet 18 may be unitized for transport by wrapping prestretched film 20 from film wrapping apparatus 10 around the goods. The mobility of the present invention allows the goods to be wrapped wherever they happen to be situated. The need to transport and manipulate the load is thus eliminated along with the waiting lines frequently associated with stationary film wrapping equipment. The maneuverability and speed of vehicle 12 in conjunction with the compact self contained nature of film wrapping apparatus 10 facilitates rapid wrapping of the goods. By controllably applying tension and heat (as more fully described hereinafter), the present invention prestretches film 20 so that fewer wraps and less film is required to wrap a particular load as compared with existing portable cold wrap devices.

Figure 2:
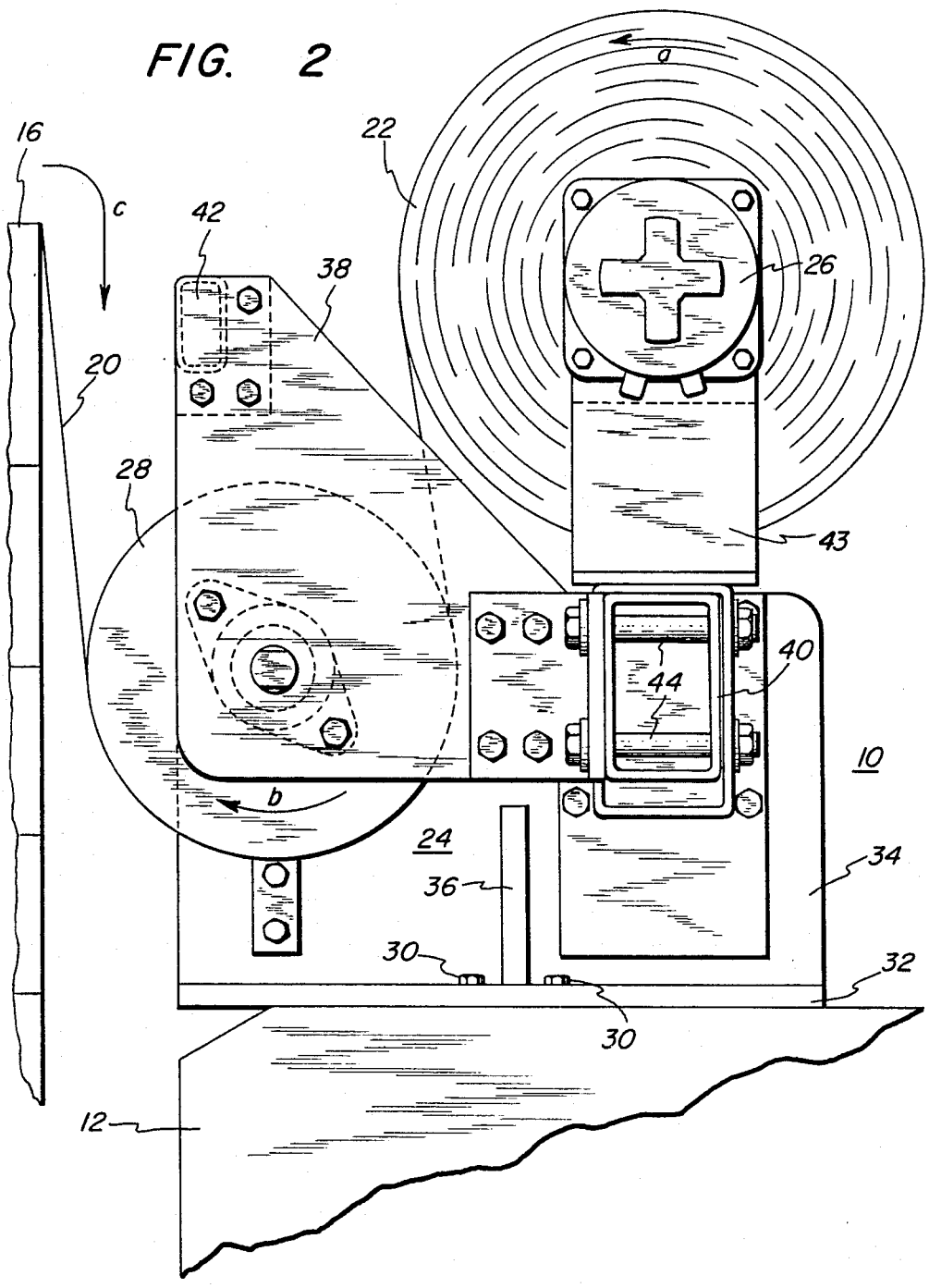
FIG. 2 is a plan view, partially cut away, of the invention.

FIG. 2 is a top view illustrating the dispensing of prestretched film 20 from film wrapping apparatus 10. A supply roll 22 of film is held in a generally vertical orientation by a support structure, generally denoted 24, of wrapper 10. Film 20 unwinds from roll 22 in a clockwise direction as indicated by arrow a. The speed at which film 20 is dispensed from roll 22 is controlled by a variable tension brake 26.

The film then contacts a vertically disposed heated roller 28. As more fully discussed subsequently, heated roller 28 is mounted to rotate in a direction shown by arrow b, in response to the rotational forces exerted on it by the film. The outer surface of roller 28 is heated to a controlled temperature which causes film 20 to stretch prior to application to load 16. The film is initially secured to the load, in known manner, and then wrapped around the load in a counterclockwise direction, as shown by arrow c, by driving vehicle 12 and attached apparatus 10, about the load. After the appropriate number of wraps have been completed, the film may be cut, the wrapping equipment driven to a new load and the process repeated.

The support frame 24 of wrapper 10 may be secured to the rear of vehicle 12 by bolts 30 or other known attachment devices, e.g. a weldment, brackets hitches, etc.

Support frame 24 includes a vertical mounting plate 32, base member 34, gusset 36 and a top plate 38 supported by a main upright 40 and an outboard upright 42. Also shown in FIG. 2 is an upper film roll bracket 43 which is adjustable in height via bolts 44 inserted through main upright 40. Support structure 24 is highly compact occupying a horizontal area of only approximately 2 feet by 2 feet. The interrelationship and functions of the various components of support structure 24 will be more fully described in connection with the subsequent views.

Figure 3:
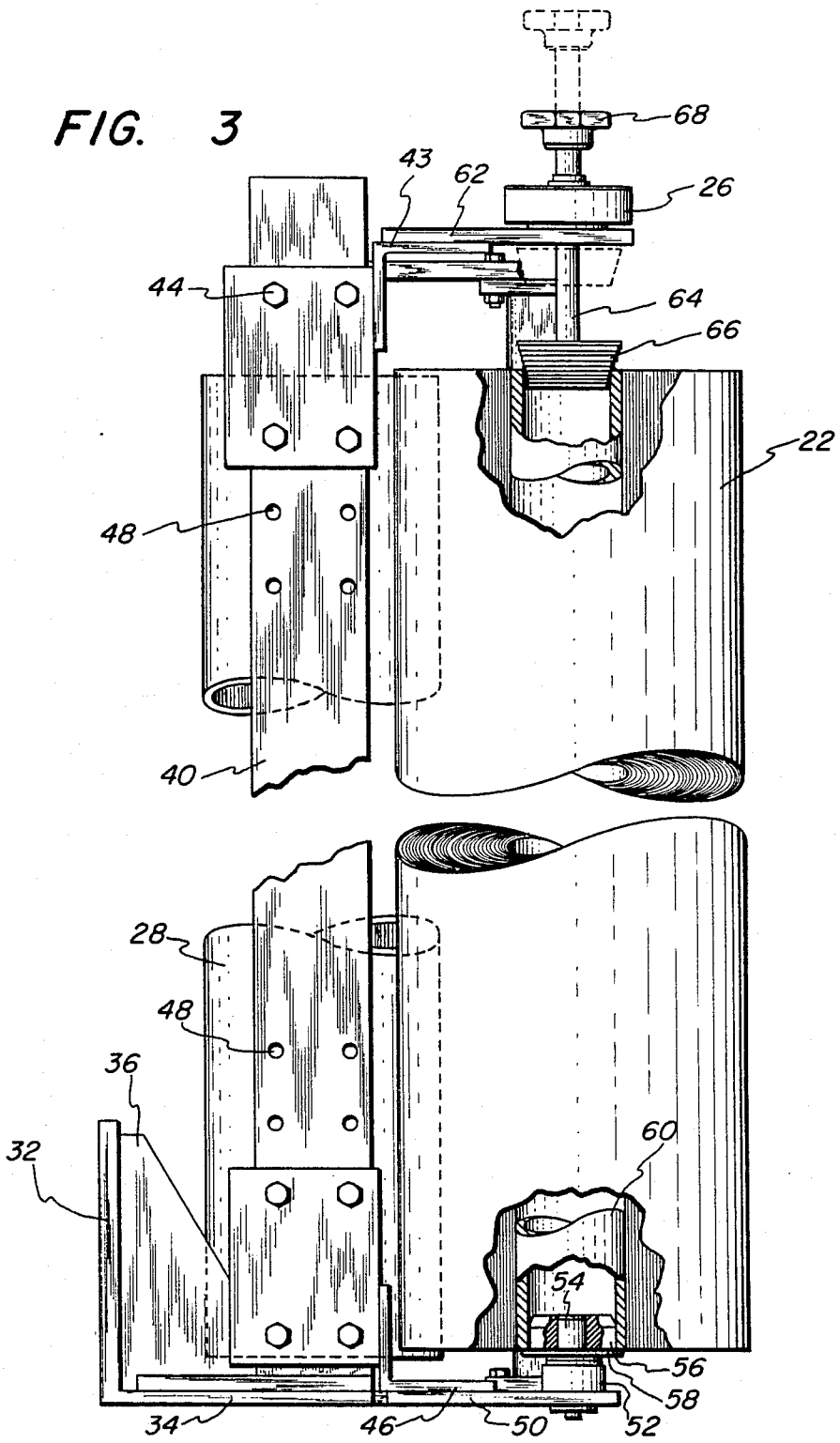
FIG. 3 is a side elevational view, partially cut away, of the mobile film wrapper of the present invention.

FIG. 3 illustrates the structure for supporting supply roll 22 in a substantially vertical orientation. As shown therein, main upright 40 cooperates with an upper L-shaped bracket 43 and a lower L-shaped bracket 46. Spaced holes 48 in main upright 40 permit vertical adjustment of the spacing between brackets 43 and 46 to accomodate film rolls of different heights.

Near the end of the extended horizontal leg 50 of lower bracket 46 is mounted thrust bearing 52. Bearing 52 supports a shaft 54 and associated roll plug 56 and retaining plate 58 for rotation about a substantially vertical axis. Plug 56 fits within the opening at the lower extremity of hollow core member 60 of roll 22 while plate 58 supports this core member.

Passing through the extended horizontal leg 62 of upper bracket 43 is an upper supply roll shaft 64. Attached to the lower end of shaft 64 is a tapered plug 66 dimensioned to be at least partially inserted into an opening at the upper extremity of hollow core member 60. A handle 68 is provided at the top end of shaft 64 so that the upper shaft and plug may be raised, as shown in phantom, to facilitate changing of the supply roll.

Shaft 64 also passes through an electrically powered adjustable tension brake 26 which serves to control the speed of rotation of supply roll 22 and therefore the tension under which the film is dispensed from this roll. A suitable brake is available from the Rockford Dynatorq Company of Rockford, Ill.

Figure 4:
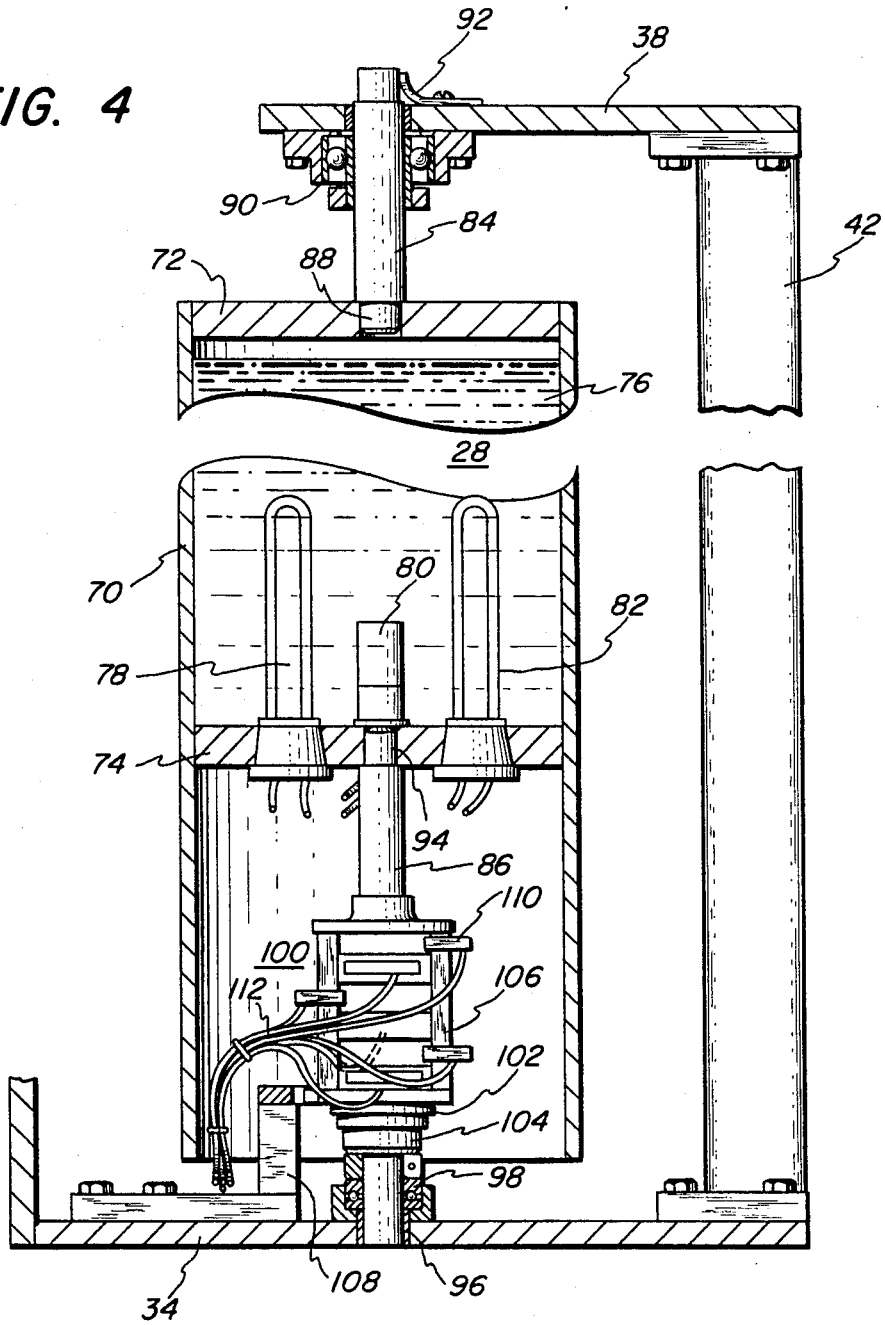
FIG. 4 is a cross sectional view of the heated roller means of the present invention.

FIG. 4 depicts the unique, self contained heated roller employed in the preferred embodiment of the present invention. Roller 28 includes a hollow cylindrical tube 70 made of heat conducting material e.g. aluminum. End cap 72 is located at the top of tube 70 while a lower end cap 74 is located near the bottom of tube 70. The cavity formed within tube 70, between end caps 72 and 74, is filled with a heating fluid 76. Although other liquids including plain water can be used, a mixture of 50% water and 50% glycol is the presently preferred heating fluid. The fluid preferably fills the cavity almost to the level of top end cap 72. A venting aperture (not shown) may be incorporated into top end plate 72 although this is not presently considered necessary.

Immersed within heating fluid 76 and mounted to bottom end cap 74, are a D.C. heating element 78, a thermostatic switch 80 and an auxiliary rapid heat-up A.C. heating element 82. The operation of these elements will be described subsequently.

Heated roller 28 is mounted for rotation about a substantially vertical axis by upper roller shaft 84 and lower roller shaft 86. End 88 of upper shaft 84 is secured within top end cap 72, as shown, so that shaft 84 rotates in conjunction with heated roller 28. The other end of shaft 84 is journaled within a thrust bearing 90 to facilitate free rotation. Bearing 90 is mounted to top plate 38, as, may be, a grounding contact 92.

Lower shaft 86 extends between base member 34 and bottom end cap 74. The top end 94 of shaft 86 is firmly secured within end cap 74 so that the lower shaft 86 rotates with heated roller 28. The bottom extremity of shaft 86 is journaled within a bushing 96 and thrust bearing 98 for free rotation.

Mounted around lower shaft 86 is a slip ring assembly generally identified as 100. The slip ring assembly includes an inner sleeve 102 secured to shaft 86 by a clamp collar 104 to rotate along with shaft 86. Inner sleeve 102 includes axially spaced, annular slip rings connected to a slip bus (not shown) which in turn connects to D.C. heating element 78, thermostatic switch 80 and A.C. heating element 82.

A brush holder assembly 106 is maintained in a fixed concentric spaced relationship about inner sleeve 102 by bracket 108 secured to base member 34. Assembly 106 preferably carries six brushes 110 cooperating with six corresponding rings on inner sleeve 102. A different pair of brush-ring sets is allocated to each of the two heating elements and the thermostatic switch. A series SR200 slip ring available from the Aero Motive Manufacturing Company of Kalamazoo, Mich. has been found suitable for this purpose.

Bundled cables 112 connect the brushes of slip ring assembly 100 to appropriate external circuitry, more fully described hereinafter. Although A.C. heating element 82 is preferably powered through common slip ring assembly 100, since it is only intended to be employed when heated roller 28 is stationary, it can alternatively be wired for direct connection to an external A.C. power line, e.g., via an outlet (not shown) mounted on and through the lower portion of tube 70.

In operation heated roller 28 is rotated by contact with the film being dispensed from the wrapping apparatus. Power is transferred to D.C. heating element 78 via slip ring assembly 100. Heating element 78 warms fluid 76 and maintains the fluid at a desired temperature under regulation of thermostatic switch 80. Heat from fluid 76 is transferred through the wall of tube 70 to prestretch the film wound around heated roller 28 in known manner. Prestretching allows unitizing of a load with fewer wraps and saves on film. Roller 28, in its preferred embodiment, has an outer diameter of approximately eight inches affording greater contact area than other known devices. The self-contained nature of heated roller 28 eliminates the need for a separate reservoir, pump, hoses etc. (commonly associated with existing inground systems) and adds to the compactness and mobility of the present invention.

Figure 5:
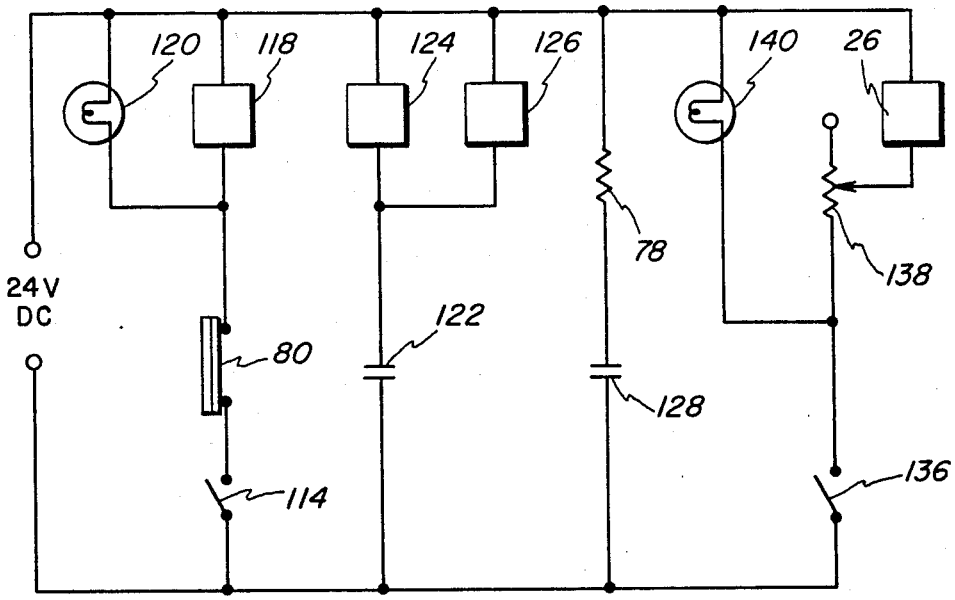
FIG. 5 is a schematic of a D.C. circuit useful in the present invention.

A typical D.C. circuit for use in conjunction with the film wrapping apparatus of the present invention is shown in schematic form in FIG. 5. The wrapping apparatus is preferably powered from the same power supply as the self propelled vehicle to which it is attached. In FIG. 5, a 24 V battery is used for this purpose. The circuit also includes a heat control switch 114 connected to thermostat 80 which in turn is connected to heating control relay 118 and indicator light 120. Relay 118, when energized, closes normally open contact 122 energizing in turn D.C. heating contactor relay 124 and A.C. heating contactor relay 26. Relay 124 energizes D.C. heating element 78 through normally open contactor 128. Similarly relay 126 serves to activate A.C. heating element 82 by closing normally open contactor 130 and connecting the A.C. heating element to an A.C. source 132 (see FIG. 6). An indicator light 134 is employed to indicate when the wrapping apparatus is connected to an A.C. source.

Referring back to FIG. 5, a tension control switch 136 is used to activate film tension brake 26. Rheostat 138 permits adjustment of the tension level while indicator light 140 indicates when the brake is energized.

Figure 6:
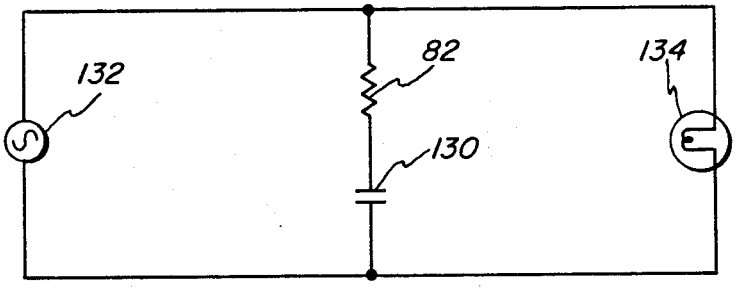
FIG. 6 is a schematic of an auxiliary A.C. circuit useful in the present invention.

The switches, lamps and relays of the circuits shown in FIGS. 5 and 6 may advantageously be located in control panel 14 shown in FIG. 1. Lamps 120 and 140 may be green when lit to indicate the operational readiness of the film wrapping apparatus. Lamp 134 may be red when lit to indicate to the operator that the apparatus should be disconnected from the auxiliary A.C. source prior to use.

The operation of the mobile film wrapper of the present invention will now be described. First the supporting structure 24 is mounted, either permanently or removably, to the rear of a self propelled vehicle. A supply roll of film is then located on the frame and supply roll brackets 43 and 46, adjusted, as appropriate, to support the roll at a desired height. The film wrapping apparatus is connected to the D.C. power supply of the self propelled vehicle.

The temperature of the heated roller may be raised to a desired level using only the D.C. heating element. However, to give faster initial heat-up an additional A.C. heating element is built into the roller. To use this auxiliary rapid heat-up element, the operator would drive the vehicle over to a 110 V A.C. outlet and plug in an auxiliary extension cord to a pigtail or similar connection on the control panel. A red caution light 134 on the control panel will come on indicating that 110 V A.C. is being applied for quick heatup. Turning on heat control switch 114 applies D.C. power to thermostatic switch 80. D.C. heating element 78 and A.C. heating element 82 will heat the heating fluid in the roller until thermostatic switch 80 is satisfied. While the heating elements are energized, indicater lamp 120 is lit. The preset thermostatically regulated temperature of the heated roller will depend upon the type of film used, ambient conditions and the particular construction of the heated roller. When a desired preset temperature is reached, indicator light 120 will go off.

The A.C. extension cord is then disconnected and the mobile film wrapping apparatus driven to the load to be wrapped. The operator then dismounts from the vehicle, makes sure tension control switch 136 is off which releases brake 26, pulls the film around the heated roller and attaches it to the merchandise. He then returns to the vehicle, turns on tension switch 136, adjusts the tension to a desired level using rheostat 138, and then drives clockwise around the merchandise the appropriate number of times to unitize the load. A minimum of two wraps is recommended because the film strength is much greater doubled. After wrapping, the film is cut and the mobile film wrapping apparatus driven to the next load to be wrapped. During continued use, the D.C. circuit, previously described, maintains the heated roller at the desired temperature for prestretching the film.

It will thus be apparent that a practical, efficient and highly versatile mobile film wrapper has been developed which fulfills all of the objects previously set forth and provides numerous significant advantages over existing equipment. Although a preferred embodiment of the invention has been described and illustrated, it will be understood by those skilled in this art that various modifications, substitutions and rearrangements can be made without departing from the scope of the present invention as defined by the claims appended hereto.

What we claim is:

1. Mobile film wrapping apparatus for dispensing heated stretchable film and rapidly wrapping the film about stationary goods, comprising:

first means for holding a supply roll of stretchable film in a substantially vertical orientation for film dispensing, said first means being adjustable to accommodate film rolls of different heights;

second means for controlling the speed at which said film is dispensed from said supply roll, said second means comprising an electrically powered adjustable tension brake;

a self-contained heated roller, about which the film from the supply roll is partially wound, for heating said film to facilitate stretching of said film prior to the film being wrapped around said goods, said heated roller being at least partially DC powered and mounted for rotation about a substantially vertical axis, said rotation resulting from contact with said film;

said heated roller comprising: a hollow cylindrical tube constructed of heat conducting material having a top end cap and a bottom end cap, the tube and end caps forming an interior cavity which serves as a reservoir for heating fluid, a heating element mounted within said cavity for immersion in said fluid, said heating element comprising a first DC heating element and a second auxiliary AC heating element, said auxiliary heating element being selectively connectable to an AC power source for rapid heat-up of the fluid, and a thermostatic switch mounted within said cavity for sensing the temperature of the fluid, said heating elements and thermostatic switch being rotatable along with said tube about said substantially vertical axis;

relay means for activating said DC heating element when said thermostatic switch senses that the temperature of the fluid has fallen below a preselected level, said relay means simultaneously activating said AC heating element when said AC heating element is connected to an AC power source;

an upper shaft attached to said top end cap and extending upwardly therefrom and a lower shaft attached to said bottom end cap and extending downwardly threfrom, said shafts cooperating with bearing units mounted on a common support means to permit said tube to freely rotate about said substantially vertical axis, and a slip-ring assembly associated with one of said shafts for connecting the DC heating element and thermostatic switch within said tube to an electric power supply;

common support means for supporting said first means, second means and said heated roller;

third means for attaching said common support means to a self-propelled vehicle; and a self-propelled, operator driven vehicle, said vehicle being powered by a DC power source, said DC power source also supplying power to said tension brake, said DC heating element and said thermostatic switch, whereby goods can be rapidly wrapped with prestretched film under tension by driving said vehicle and attached film wrapping apparatus around said goods.

2. The apparatus of claim 1 further comprising a control panel mounted on one of said common support means and said self propelled vehicle, said control panel comprising:

a first switch for connecting said D.C. power source to a circuit including said thermostatic switch, relay means and D.C. heating element;

a second switch for connecting said D.C. power source to said brake;

and indicator means for indicating when the heating elements and brake are activated.

3. The apparatus of claim 2, wherein said A.C. power source comprises a 110 V alternating current supply and said D.C. power source comprises a 24V direct current supply.

4. The apparatus of claim 3, wherein said common support means occupies a horizontal area not substantially greater than two feet by two feet.

* * * * *